US006520092B2

(12) United States Patent
Marshall et al.

(10) Patent No.: US 6,520,092 B2
(45) Date of Patent: Feb. 18, 2003

(54) MECHANICS PORTABLE ADJUSTABLE TOOL TRAY ADAPTED TO BE SUPPORTED ON OPPOSED EDGE CONFIGURATIONS OF A VEHICLE ENGINE COMPARTMENT

(76) Inventors: Darrin A. Marshall, 4320 W. Battle Rd., Farwell, MI (US) 48622; Arthur A. Marshall, 6991 Fordyce Rd., Farwell, MI (US) 48622

( * ) Notice: Subject to any disclaimer, the term of this patent is extended or adjusted under 35 U.S.C. 154(b) by 0 days.

(21) Appl. No.: 09/999,101

(22) Filed: Oct. 31, 2001

(65) Prior Publication Data

US 2002/0059887 A1 May 23, 2002

Related U.S. Application Data

(60) Provisional application No. 60/249,743, filed on Nov. 17, 2000.

(51) Int. Cl.[7] ..... A47B 23/00

(52) U.S. Cl. ..... 108/44; 108/137

(58) Field of Search ..... 108/44, 43, 42, 108/49, 143, 137, 25, 45; 224/42.11, 42.13; 297/180.12, 180.18

(56) References Cited

U.S. PATENT DOCUMENTS 89,146 A * 4/1869 Hatch
1,888,736 A * 11/1932 Park
2,007,541 A * 7/1935 Leavens
3,078,478 A * 2/1963 Sheahan
3,163,287 A * 12/1964 Barnett
3,199,467 A * 8/1965 Compton
3,276,045 A * 10/1966 Bement
3,698,330 A * 10/1972 Krombach
3,813,714 A * 6/1974 Sater
4,811,875 A 3/1989 DiSimone
5,331,904 A 7/1994 DiSimone et al.
5,443,019 A * 8/1995 Sheldrick
5,479,866 A * 1/1996 Rae
5,690,415 A * 11/1997 Krehl
5,758,585 A * 6/1998 Latchinian
5,937,766 A * 8/1999 Denny

* cited by examiner

*Primary Examiner*—José V. Chen
(74) *Attorney, Agent, or Firm*—Reising, Ethington, Barnes, Kisselle, Learman & McCulloch, P.C.

(57) ABSTRACT

A portable mechanic's bench removably spans vehicle hood ledges having lateral flanges extending from upstanding fender components bordering the vehicle engine compartment and may comprise a tray with an open top. A pair of drawers with open tops are laterally telescopically received by the tray to be movable from a first position in which the drawers are in laterally inward storage position to an outwardly extended operative position. Legs diverge downwardly and laterally outwardly to exert wedging stress on the fender upstanding components to hold the bench in position.

19 Claims, 3 Drawing Sheets

MECHANICS PORTABLE ADJUSTABLE TOOL TRAY ADAPTED TO BE SUPPORTED ON OPPOSED EDGE CONFIGURATIONS OF A VEHICLE ENGINE COMPARTMENT

This application claims the priority of provisional application Serial No. 60/249,743 filed Nov. 17, 2000.

BACKGROUND OF THE INVENTION

The present invention relates to portable tool trays or benches of the character used by mechanics working on engine components within the vehicle engine compartment.

Vehicle benches of this type have been suggested to support a variety of the tools employed by the mechanic as well as the myriad small parts which the mechanic may have to remove from time to time and then reinstall. The portable benches or trays of this character which have been previously proposed, to our knowledge, have not been considered sufficiently practical to economically market.

While prior art trays have been suggested for spanning the engine compartment and seating upon the hood supporting flange configurations laterally adjacent the engine compartment, they have not provided the advantages inherent in the use of the tray of the present invention. Normally, as mechanics work on automobile engines, they tend to support tools and parts on some of the components of the engine, such as the top of the air cleaner housing and, frequently, such parts and tools are inadvertently dislodged from these temporary supports and drop down within the engine compartment where they can be lost or, at least, difficult to retrieve.

Another problem which is encountered is the storage of parts which have been removed when a particular job cannot be completed in one day and the parts removed must be stored overnight.

Still further, a tray to be marketable for the purposes indicated needs to be readily installable in position by one person, advantageously without the necessity of locking its parts in position or adjusting the position of the tray support legs.

SUMMARY OF A PREFERRED STRUCTURAL CONFIGURATION OF THE INVENTION

The present invention is concerned with an engine mechanics tool tray adapted to be supported on the laterally opposed edge ledge configurations of a vehicle engine compartment and incorporates an elongate open-ended base tray or platform section with an accessible bottom wall and longitudinally extending side walls. The side walls can function as longitudinal guide members and endwisely extensible end drawers or platforms with accessible bottom walls, longitudinally extending side walls, and end walls, are telescopically slideable into the open ends of the base tray section to a first retracted position in which the bottoms of the drawers are supported substantially in engagement with the bottom of the base tray section. In this position, in which the tray is ready for transport, tools and parts may be stored in the end drawers. On their outer ends, the drawers have downwardly and outwardly inclined support ends for supporting the tray on the hood-supporting flanges of a vehicle which has its hood raised, when the drawers are extended outwardly to a second position, without a need for locking the support ends in a particular position.

One of the prime objects of the present invention is to design an extensible tool tray device which can be used on a wide variety of vehicles having engine compartments of different size and configuration.

A further object of the invention is to provide a more easily operative tool tray which, basically, can simply have its drawers extended to the extent required for the support legs to engage and be supported upon the hood supporting flanges of the engine compartment without a need for adjusting or locking the legs in a particular position.

It is a further object of the invention to provide a tool tray of extremely practical nature which can be readily and economically manufactured and marketed for the use of mechanics.

Still another object of the invention is to provide a tray which is very flexible in use and in which, regardless of the extent of partial extensibility, can fit smaller size engine compartments.

Another further object of the invention is to provide a portable tray of the character mentioned which supports the tools in a convenient raised position above the engine components for ready access and which has platforms or drawers, which are so configured with handle surfaces, that the platforms are very easily extended to the proper position for support within the engine compartment.

Other objects and advantages of the invention will become apparent with reference to the accompanying drawings and the accompanying descriptive matter.

BRIEF DESCRIPTION OF THE DRAWINGS

The presently preferred embodiment of the invention is disclosed in the following description and in the accompanying drawings, wherein.

DETAILED DESCRIPTION OF THE DRAWINGS

Figure 1:
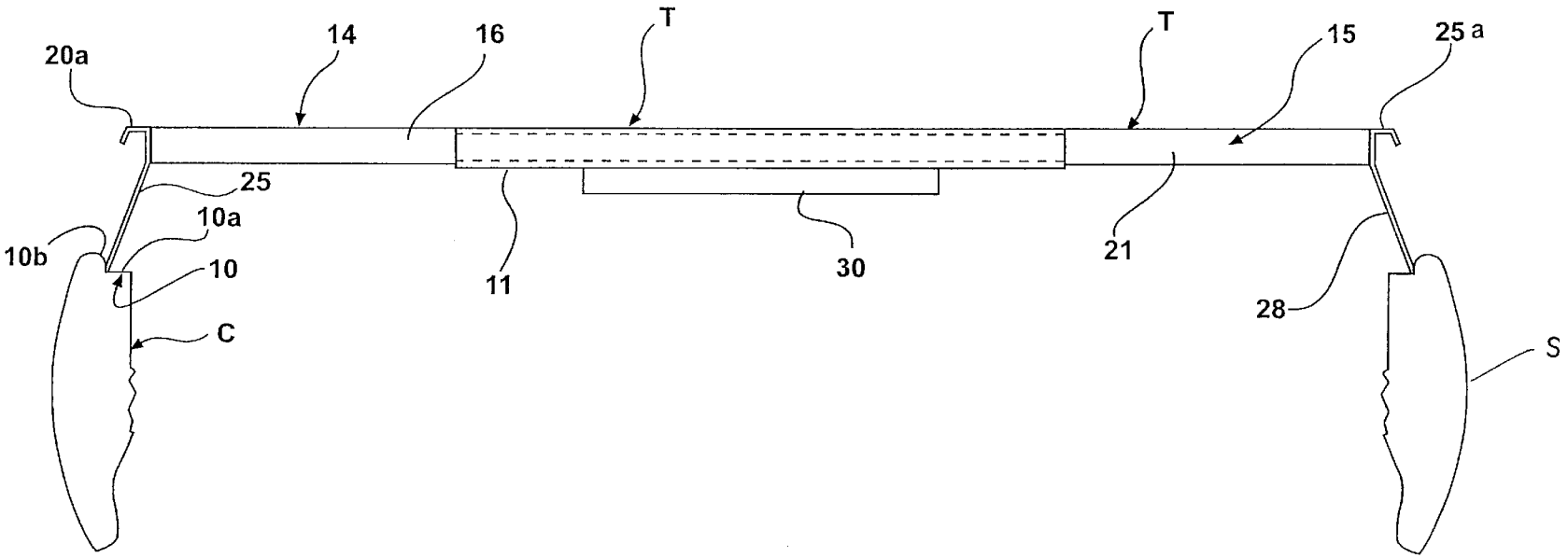
FIG. 1 is a schematic elevational view showing the manner in which the tray is supported in position by the hood support flanges when the vehicle hood is in raised position.

Referring now more particularly to the accompanying drawings, and in the first instance to FIG. 1, a vehicle, generally designated V, is disclosed as having an engine compartment, generally designated C, with a plurality of engine components housed therein in the usual manner. The vehicle hood will be in a raised position and the overall tray device, generally designated T, is shown as in an extended position, supported on the opposed hood supporting flanges or ledges 10 of the vehicle body sides S, which typically include a horizontal surface 10*a* and a vertical wall surface 10*b* forming a confluent upwardly open corner or socket configuration.

Figure 2:
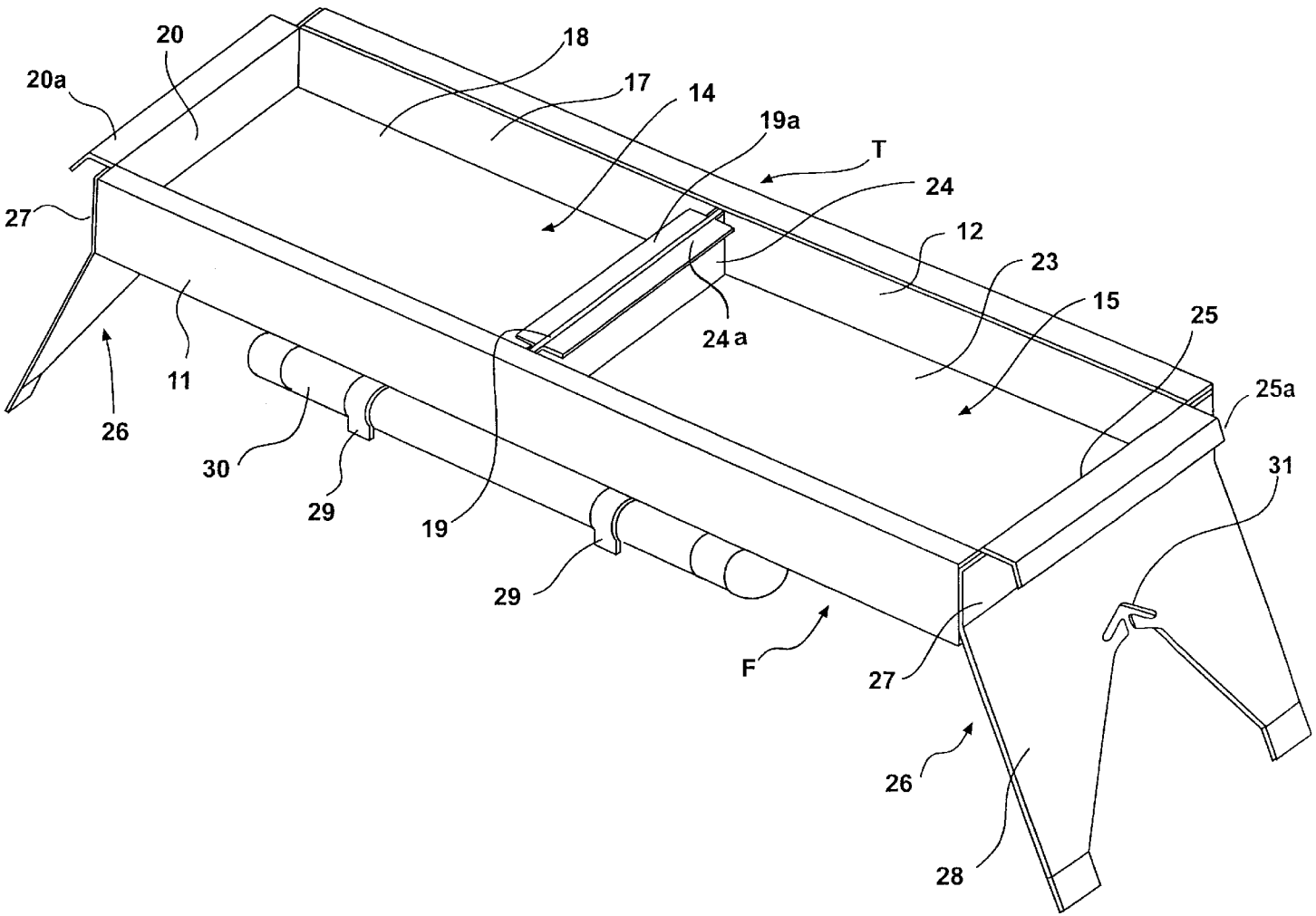
FIG. 2 is a schematic perspective plan view of the portable tray only, extension drawers being shown in the closed position.
Figure 3:
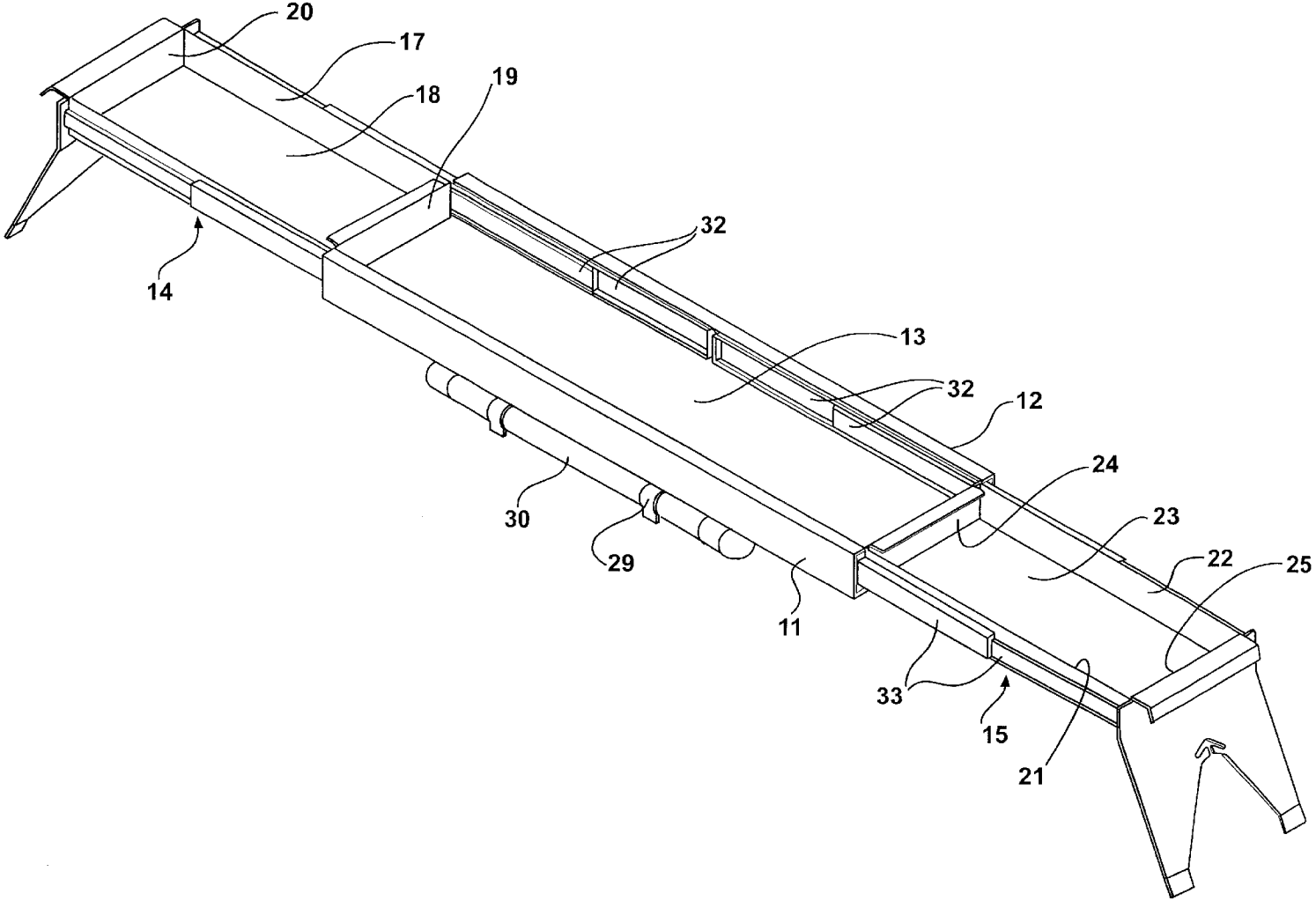
FIG. 3 is a schematic perspective plan view showing the drawers in an extended position.

In FIGS. 1 and 3, the tray T is shown in expanded or extended position. The tray T illustrated comprises a tool support structure, base or platform, generally designated F, with open ends and an open top, comprising side channel members 11 and 12 and a bottom or floor member 13. Telescopically received by the side members 11 and 12 are end drawer elements or platforms, generally designated 14 and 15, which are extensible from the position shown in FIG. 2 to the position shown in FIGS. 1 and 3. The drawer 14 includes side walls 16 and 17 and a bottom or floor wall 18. The drawer 14 further includes inner end wall 19 and outer end wall 20.

The drawer 15 includes side walls 21 and 22, a bottom or floor wall 23, an inner end wall 24, and an outer end wall 25. Secured to the outer face of the drawer walls 20 and 25 are end support elements, generally designated 26, comprising upper vertical portions 27 and bifurcated lower or leg portions 28 which extend angularly downwardly and outwardly as shown particularly in FIG. 1. Typically, the tray T is constructed of metallic elements.

Mounted beneath the main section 11 and its bottom 13 are C-shaped clamps 29 which releasably support a luminiferous or luminous member comprising preferably an electrically energized fluorescent light bulb of conventional and commercially available construction 30. The lighting member may also comprise an incandescent bulb or a plurality thereof. The cooler operating bulb 30 directs light rays downwardly and some of its light rays also reflect off the bottom of floor 13 down into the engine compartment. One or both of the leg sections 8 may be provided with a slot 31 to pass the cord leading from the bulb 30. It is to be observed that the end wall 20 has an outwardly projecting handle flange 20*a* and the end wall 19 has an outwardly projecting handle flange 19*a*. Likewise, the end wall 25 has an outwardly projecting handle flange 25*a* and the wall 24 has an outwardly projecting handle flange 24*a*.

FIGS. 1 and 2 simply show the drawers 14 and as slideably telescoped into the channel members 11 and 12 which support them with bottoms 18 and 23 slightly above the level of bottom 13. Provided on the interior side walls 11 and 12 of the tray construction shown in FIGS. 3 and 4, are conventional ball bearing drawer slides 32 which interact with drawer slides 33 provided on the drawer walls 21, 22 and 17–18. The drawer slides 32 and 33 operate in the usual manner to guide the drawers 14 and 15 in their inward and outward travel and will not further be described. They may be of the conventional type marketed by Heffich International Company of the U.S.A. While I have shown drawer slides as a practical way of guiding the drawers in telescopic movement, rib and groove guides could be provided on the side walls 11 and 12, and the walls 21, 22, 17, and 18, or no guides need be provided at all, so long as the drawers telescope.

As FIG. 3 particularly indicates, when the drawers 14 and 15 are in retracted position, the bottoms 18 and 23 of the drawers function to provide support surfaces for tools and parts. which remain accessible. It may be that a mechanic may choose to have tools in one of the drawers 14 and parts in the other or engine parts in the drawers 14 and tools on the floor 13 when the drawers are extended. In this position of the parts, the floors 18 and 23 of the respective drawers 14 and 15, are only slightly spaced vertically when the drawers 14 and 15 are in extended position as shown in FIG. 3. The floors or bottoms 18 and 23, when extended, provide substantially a continuation of the floor bottom 13 and all floors 13, 18, and 13 are open topped and accessible.

While the invention certainly does not require particular dimensions, typically, the fully expanded length of the tray provides a total of 64 inches of working space which would, for example, be used when the mechanics tray was being used on a typical Chevrolet truck. On the Saturn automobile, 42 inches of working space is obtained with the drawers 14 and 15 in a partly retracted position to fit the engine compartment.

The Operation

It is important to realize that the tray can be easily set up by one person using both hands to pull the drawers out. For instance, the handle flanges 19*a* and 24*a* can be grasped and pulled apart by one person to extend the drawers 14 and 15 to the support position. Legs 26 are of a length such that it is possible to work under the tray T and the bulb 30 at the front edge of the tray provides the necessary illumination in both directions forwardly and rearwardly. Because the portions 28 of the legs 26 angle outwardly and downwardly, the weight of the tray T with its contents create spreading or wedging engagement forces which firmly anchor the legs 26, and thereby the tray T, in position, and it is not necessary to provide any kind of a locking device. The fact that floor 13 is accessible to hold heavy objects aids this anchoring of the tray T when the drawers are extended and in operative supported position. In this position, the inner ends of the drawers 14 and 15 remain sufficiently in lapped relationship with the tray T to be supported thereby. When it is desired to restore the drawers to the FIG. 2 position, one of the ends walls 20 or 25 and the opposite end wall 19 or 24 may be grasped to pull the drawers inwardly after the tray is lifted sufficiently to clear the engine compartment. Tools and parts can be left in position resting on the surfaces 18 and 23.

It is understood that the disclosed embodiment is representative of a presently preferred form of the invention and that others that accomplish the same function are incorporated herein within the scope of the appended patent claims.

We claim:

1. A portable mechanic's bench for removably spanning vehicle hood ledges having lateral flanges extending from upstanding fender walls to provide an upwardly open confluent socket wall configuration bordering the engine compartments of diverse vehicles comprising:

a. a tray of generally U-shape with an open top, including a bottom wall and upstanding laterally extending side walls along said open top, which provides access to said tray bottom wall;

b. a pair of drawers of generally U-shape with open tops, including drawer bottom walls and upstanding side walls extending along said open tops which provide access to said bottom walls, laterally telescopically received by said tray to be movable in laterally opposite directions from a first position in which said drawers are in laterally inward storage position to a laterally outwardly extended operative position in which said tray bottom wall and said drawer bottom walls are all available as upwardly open tool and part support surfaces; and c. legs dependant from said drawers, said legs angling downwardly and laterally outwardly relative to said drawer bottom walls in relative divergent relation to provide lateral as well as vertical components of engagement pressure, said legs terminating in lowermost edge portions extending in divergent relation in a direction to engage said confluent wall configuration and exert spreading forces on said fender upstanding walls augmented by the weight of articles in said tray and said drawers and hold said bench in position.

2. The bench of claim 1 wherein said drawers have transversely outer end walls and said legs are an integral extension thereof.

3. The bench of claim 1 wherein said legs angle laterally outwardly relative to a vertical plane at an angle in the range of 10 to 45 degrees.

4. The bench of claim 3 wherein said angle is about 15 degrees.

5. The bench of claim 1 wherein said drawers have transversely inner end walls upstanding from said drawer bottom walls and the upper ends of said inner end walls have transversely outwardly extending flanges forming opposing hand holds.

6. The bench of claim 1 wherein said tray bottom wall includes a light reflective external lower surface and has an upwardly and downwardly open electrically powered luminous member mounted on said external surface to project light downwardly into the engine compartment and upwardly to said light reflective surface for redirection downwardly to said engine compartment.

7. The bench of claim 6 wherein laterally spaced, U-shaped, downwardly open resilient clips releasably mount said luminous member on said bottom wall of said tray.

8. In combination with a vehicle hood fender structure having laterally spaced hood ledges with vertical and laterally inturned wall components forming an upwardly open confluent corner configuration on opposite sides of and bordering the vehicle engine compartment to support the hood;

a portable mechanic's bench with opposed ends for removably spanning said vehicle hood ledges; said bench comprising:

a. a first tool support platform of generally U-shape with an open top; another tool support platform comprising a drawer of generally U-shape including a drawer bottom wall with upstanding side walls bordering an open top relatively telescopically mounted to be relatively removable from a first position in which said platforms are in a laterally compressed storage position to a laterally expanded operative position; and b. dependent bench legs angling downwardly and outwardly relative to said platforms in divergent relation to support said opposed ends of said bench and provide lateral as well as vertical components of engagement pressure, said legs having terminal lower ends extending in said divergent relation in a direction to engage said corner configuration and exert wedging forces on said ledge wall components and anchor said bench legs and thereby said bench in position.

9. The bench of claim 8 wherein said platforms have outer end walls and said legs are an integral extension thereof.

10. The bench of claim 8 wherein at least one of said platforms has an inner end wall portion with a hand hold thereon.

11. The bench of claim 8 wherein said legs angle downwardly and outwardly at an angle in the range of 10–45 degrees.

12. The bench of claim 8 wherein an upwardly and downwardly open luminous member mounts on an exterior bottom surface of said first tool support platform.

13. A method of making a portable mechanic's bench for removably spanning vehicle hood ledges having lateral flanges extending laterally inwardly from upstanding fender wall components to provide upwardly open confluent angular socket configurations bordering the engine compartments of diverse vehicles comprising: a tray of generally U-shape including a bottom wall with upstanding transversely extending side walls open at its top to provide access to said tray bottom wall; a drawer mechanism of generally U-shape including a drawer bottom wall with upstanding side walls open along the top to provide access to said drawer bottom wall telescopically received by said tray to be removable from a first position in which said drawer mechanism is in transversely inward storage position to an extended operative position; comprising providing legs dependent from the ends of said bench, said legs angling downwardly and outwardly relative to said bench in divergent relation to provide lateral as well as vertical components of reactance support, said legs terminating in lower free edge portions extending in a direction to engage said confluent configurations and exert spreading forces on said engine compartment upstanding wall components and hold said bench in position without the need of ledge locks.

14. The method of claim 13 comprising providing said drawer mechanism as oppositely telescoping drawers with transversely inner end walls upstanding from drawer bottom walls and providing the upper ends of said inner end walls with transversely outwardly extending flanges forming opposing hand holds.

15. The method of claim 13 wherein said legs diverge at an angle of about 10–45 degrees from vertical planes.

16. The method of claim 13 comprising providing one of said bottom surfaces with clips for releasably securing an elongate luminous apparatus and providing a connection for electrical energy to illuminate the engine compartment.

17. The method of claim 13 comprising providing said tray bottom surface as a light reflective surface and mounting a light source on said tray bottom surface open to project light downwardly into the engine compartment and upwardly to said light reflective surface.

18. A method of making a portable mechanic's bench for removably spanning vehicle hood ledges having lateral flanges extending laterally inwardly from upstanding fender wall components to provide upwardly open confluent angular socket configurations bordering the engine compartments of diverse vehicles comprising:

a. providing an open ended tray of generally U-shape including a bottom wall with upstanding transversely extending side walls and open at its top to provide access to said tray bottom wall;

b. providing opposed drawer mechanisms of generally U-shape, including drawer bottom walls with upstanding side walls and open along the top to provide access to said drawer bottom walls, telescopically received by said tray at the open ends thereof to be removable from a first position in which said drawer mechanism is in transversely inward storage position to an extended operative position in which said tray bottom wall and said drawer bottom walls are all available as upwardly open support surfaces for tools and parts; and c. providing legs dependent from the outer ends of said drawer mechanisms, said legs extending downwardly from said bench and terminating in lower free edge portions extending in a direction to engage said confluent configurations and configured to support said bench in position without the need of ledge locks.

19. The method of claim 18 comprising providing said tray bottom surface as a light reflective surface and releasably mounting a light source on said tray bottom surface open to project light downwardly into the engine compartment and upwardly to said light reflective surface.

* * * * *